US005571442A

United States Patent [19]

Masaki et al.

[11] Patent Number: 5,571,442

[45] Date of Patent: Nov. 5, 1996

[54] TEXTILE TREATING COMPOSITION

[75] Inventors: Takao Masaki, Yamatotakada; Tomoo Komatsubara, Kashiwara; Seizi Nakanishi, Higashiosaka, all of Japan

[73] Assignee: Matsumoto Yushi-Seiyaku Co., Ltd., Osaka-fu, Japan

[21] Appl. No.: 469,823

[22] Filed: Jun. 6, 1995

[30] Foreign Application Priority Data

Feb. 1, 1995 [JP] Japan ..... 7-015026

[51] Int. Cl.[6] ..... D06M 13/224; D06M 15/643

[52] U.S. Cl. ..... 252/8.62; 252/8.61; 252/8.84; 252/312; 106/287.11; 524/838

[58] Field of Search ..... 106/287.11; 252/8.6, 252/8.8; 528/26, 38; 524/838, 863

[56] References Cited

U.S. PATENT DOCUMENTS

| | | | |
|---|---|---|---|
| 4,247,330 | 1/1981 | Sanders, Jr. | 106/287.11 |
| 4,388,437 | 6/1983 | Ona | 106/287.11 |
| 4,661,557 | 4/1987 | Jo Lane et al. | 106/2 |
| 4,973,620 | 11/1990 | Ona et al. | 106/287.11 |
| 5,078,747 | 1/1992 | Kastele et al. | 252/8.6 |
| 5,244,598 | 9/1993 | Merrifield et al. | 106/287.11 |
| 5,281,658 | 1/1994 | Ona et al. | 106/287.11 |
| 5,403,886 | 4/1995 | Chrobaczek et al. | 106/287.11 |

FOREIGN PATENT DOCUMENTS

| | | |
|---|---|---|
| 52-24136 | 6/1977 | Japan . |
| 77024136 | 6/1977 | Japan . |
| 62-045786 | 2/1987 | Japan . |
| 62-45787 | 2/1987 | Japan . |
| 2091225 | 3/1990 | Japan . |
| 6-220723 | 8/1994 | Japan . |
| 6-220722 | 8/1994 | Japan . |

*Primary Examiner*—Anthony Green
*Attorney, Agent, or Firm*—Watson Cole Stevens Davis, P.L.L.C.

[57] ABSTRACT

A textile treating composition imparting durable water repellency, detachability, heat resistance, and smooth and slick handle to acrylic fiber and polyacrylo- nitril precursors for carbon fiber; and minimizing stain on guides or rolls in fiber processing is disclosed. The composition comprises amino-modified polysiloxanes, monoesters of dicarboxylic acids, nonionic surfactants, and amino carboxylic acids.

5 Claims, No Drawings

TEXTILE TREATING COMPOSITION

BACKGROUND OF THE INVENTION

The present invention relates to a textile treating composition containing amino-modified silicone oils.

Linear polysiloxanes, so-called silicone oil, have been broadly employed in textile treating compositions for acrylic fibers which are processed into clothings or applied as the precursor in carbon fiber production, because of the water repellency, detachability, heat resistance, peculiar handle, i.e., smoothness or slickness, which are imparted to fiber by silicone oil. Particularly, the linear amino-modified polysiloxanes having amino groups in their molecules have proved superior performance as a component of textile treating compositions for acrylic fibers for clothing or for the precursors of carbon fibers. Because the linear amino-modified polysiloxanes can be dispersed into fine globules with suitable emulsifiers.

Amino-modified polysiloxanes have also proved superior performance as a textile treating agent for preventing the fusion or adhesion of organic and inorganic fibers in heat treatment, because of their detachability and heat resistance. The fusion or adhesion of fibers results in poor fiber quality.

Many processes for applying textile treating compositions containing amino-modified polysiloxanes to fibers have been proposed in literature, such as Japanese Patent KOKOKU (Publication for opposition) No. Sho. 52-24136, Japanese Patent KOKAI (Provisional Publication) No. Sho. 62-45786 and No. Sho. 62-45787, Japanese Patent KOKAI No. Hei. 6-220722 and No. Hei. 6-220723 and others.

Amino-modified polysiloxanes can be dispersed into fine globules of 0.1 micrometer or less in diameter in an aqueous emulsion with the aid of an emulsifier having acidic groups. The fine globules are attained by the hydrophilic amino salts generated from the reaction of basic amino groups in the amino-modified polysiloxanes and acidic groups in the emulsifiers blended with the amino-modified polysiloxanes. The above aqueous emulsion is almost transparent, and thus the amino-modified polysiloxanes seem to have been dissolved. Actually, however, they are dispersed into fine globules of approximately several decades of milimicrometer giving high transmittance to the resultant emulsion.

Such fine globules of textile treating composition dispersed in aqueous emulsion are preferable for applying the textile treating compositions uniformly on fiber surface.

Such fine globules are indispensable for applying textile treating compositions rapidly to the surface of monofilaments located at the inside of tows or multifilament yarns.

The finish film on fiber attained by a textile treating composition dispersed in fine globules in aqueous emulsion is much more uniform than that attained by the textile treating compositions dispersed in coarse globules to give milky emulsion. Uniform finish film minimizes the decrease or variation of water repellency, detachability, heat resistance, and peculiar handle of fiber, i.e., smoothness and slickness.

Japanese Patent KOKAI No. Hei. 6-220722 and No. Hei. 6-220723 disclose that amino-modified polysiloxanes applied on fiber gradually degrade into smaller molecules during storage, due to the breakage of the molecular chain of the amino-modified polysiloxanes, when the amino-modified polysiloxanes are prepared into emulsion with the emulsifiers having acidic groups disclosed in Japanese Patent KOKOKU No. Sho. 52-24136, and Japanese Patent KOKAI No. Sho. 62-45786 and No. Sho. 62-45787. And the above KOKAI No. Hei. 6-220722 and No. Hei. 6-220723, also disclose that the heat durability, detachability, and peculiar handle imparted by the amino-modified polysiloxanes are gradually reduced due to the degradation.

The methods for solving the above problem are proposed in Japanese Patent KOKAI No. Hei. 6-220722 and No. Hei. 6-220723, in which amino-modified polysiloxanes are emulsified with nonionic emulsifiers and weak carboxylic acids instead of strongly acidic emulsifiers.

The inventors of the present invention found that the textile treating compositions disclosed in the prior art mentioned above are apt to fall from fiber to stick on the surface of guides and rolls employed in yarn-spinning or textile dyeing processes of acrylic fibers, and in the conversion processes of polyacrylonitrile precursors into carbon fibers.

The textile treating compositions sticking on the guides or rolls change into varnish type residue to cause the wrap of monofilaments of tows during long-time continuous processing. Further, the dusts in a workplace stick on the varnish type residue on the guides or rolls, causing monofilament breakage and fluffs.

A method for preventing the guides and rolls from the adhesion of textile treating compositions by adding various antioxidants has been proposed in Japanese Patent KOKAI No. Hei. 2-91225. The method may often result in the reduction of the durability of the water repellency, detachability, heat resistance, and peculiar handle imparted to fiber, though the method may prevent the varnish type residue on the guides or rolls. The antioxidants proposed in the above method are estimated to decompose amino-modified polysiloxanes into smaller molecules so as to reduce the chemical stability of the amino-modified polysiloxanes, though the antioxidants prevent the gelling of the amino-modified polysiloxanes. The function of the antioxidants, the acceleration of the decomposition of dimethylpolysiloxane into smaller molecules is described in Zh. Prikl. Khim. Vol. 49, No. 4, p 839–844 (1976).

The proper level of the gelling of amino-modified polysiloxane is preferable for attaining durable water repellency, detachability, heat resistance, and peculiar handle of the fiber. Some of the textile treating compositions comprising amino-modified polysiloxanes emulsified with phosphoric esters and blended with antioxidants cannot attain durable water repellency, detachability, heat resistance, and peculiar handle on fiber.

Antioxidants, strongly acidic substances, and basic substances, all of which minimizes the gelling of amino-modified polysiloxanes, may decompose amino-modified polysiloxanes into smaller molecules during long-term storage or heat treatment leading to the reduction of heat resistance of amino-modified polysiloxane.

SUMMARY OF THE INVENTION

An object of the invention is to provide a textile treating composition imparting water repellency, detachability, heat resistance, and peculiar handle, i.e., smoothness and slickness, all of which are durable, to acrylic fibers or polyacrylonitrile precursors for carbon fiber production.

Another object of the invention is to minimize the varnish type residue of textile treating compositions processing operation.

The textile treating composition of the present invention comprises a silicone oil (A) containing at least 50 percent by weight of an amino-modified polysiloxane having a viscosity of 50 cSt or more at 25° C. an emulsifier (B) containing monoesters of dicarboxylic acids 10 to 100 percent by weight and nonionic surfactants 90 to 10 percent by weight, and aminocarboxylic acids (C) formulated in the said textile treating composition in 0.2 to 10 parts by weight to the 100 parts by weight of the total of (A) and (B).

DETAILED DESCRIPTION OF THE INVENTION

The present invention provides a novel textile treating composition, which is dispersed into fine globules in its aqueous emulsion for achieving uniform application on fiber, forms low-viscous aqueous emulsion, gives minimum stain on guides or rolls in fiber processing, and maintains heat stability on fiber for long-term storage; and the production method thereof.

The present invention relates to a textile treating composition comprising a silicone oil (A) containing at least 50 percent by weight of amino-modified polysiloxanes having a viscosity of 50 cSt or more at 25° C.; an emulsifier (B) containing monoesters of dicarboxylic acids 10 to 100 percent by weight and nonionic surfactants 90 to 10 percent by weight, and aminocarboxylic acids (C) formulated in the said textile treating composition in 0.2 to 10 parts by weight to the 100 parts by weight of the total of (A) and (B).

The preferable nitrogen content, which represents the amine content in the amino-modified polysiloxanes of the present inventions is from 0.05 to 2.0 percent. The amino-modified polysiloxanes containing nitrogen less than 0.05 percent cannot be easily dispersed into fine globules in aqueous emulsion. The amino-modified polysiloxanes containing nitrogen 2.0 percent or more have poor heat resistance and are not applicable to the fibers to be heated at high temperature, though such polysiloxanes can be easily dispersed into fine globules in aqueous emulsion.

The amino groups contained in an amino-modified polysiloxane may be any amines of primary, secondary, tertiary, and quaternary; a mixture of amines different in the class; or combined amines of primary and secondary amines. Amines having an amino group at the terminal position may also be used.

The preferable viscosity of the amino-modified polysiloxane for obtaining satisfiable results is 50 cSt or more at 25° C.

The maximum viscosity of the amino-modified polysiloxanes is not limited, though the viscosity of less than 10,000 cSt is preferable for blending the amino-modified polysiloxanes and emulsifiers with conventional blenders. The amino-modified polysiloxanes, of which viscosity is 10,000 or more, can be blended with emulsifiers with high-performance blenders.

The silicone oil (A) of the present invention preferably consist of amino-modified polysiloxanes alone. Dimethyl polysiloxane, methylphenyl polysiloxane, and modified-polysiloxanes, such as polyether- or epoxy-modified polysiloxanes can be blended in the silicone oil (A), provided that the blended silicone oil can be dispersed into globules of which mean diameter is below 0.1 micrometer in the aqueous emulsion, and can give 20 weight percent emulsion of which transmittance is above 60 percent. Amino-modified polysiloxanes must be contained in the silicone oil (A) 50 weight percent or more for giving sufficient globule size and transmittance of the textile treating composition of the present invention. And the polyether-modified silicone in the silicone oil (A) must be restricted below 50 weight percent not to reduce the heat resistance of the resultant textile treating composition, though the globule size and transmittance of the emulsion are satisfiable even when the polyether-modified silicone is blended more than 50 weight percent.

The emulsifier (B) applicable to the present invention comprises monoesters of dicarboxylic acids and other nonionic surfactants. As the monoesters of dicarboxylic acids, any compounds represented by the following formula may include:

$$R^1—O—(AO)_mOCQCOOH \quad \text{I}$$

wherein $R^1$ is a hydrocarbon group having the carbon number of 6–22 (hereinafter referred as $C_6$–$C_{22}$), e.g., an alkyl group, aralkyl group, or aryl group having one or more substituents; and any alkyl group of these groups may have one or more unsaturated bonds and/or one or more branches; A is one of the $C_2$–$C_4$ alkylene groups which may have a branch, or is the mixture. thereof, e.g., ethylene, propylene, trimethylene, butylene, and isobutylene, tert-butylene, preferably ethylene or the mixture of ethylene and propylene; m is 0 to 20, preferably 5 to 15; and Q is a dicarboxylic acid residue, e.g., a $C_1$–$C_8$ hydrocarbon group, such as malonic acid, succinic acid, glutaric acid, adipic acid, pimelic acid, suberic acid, azelaic acid, sebatic acid, maleic acid, fumaric acid, citraconic acid, mesaconic acid, isophtharic acid, and terephtharic acid, preferably a succinic acid residue;

$$\{H(OA)_nO\}_xXO(AO)_nOCQCOOH \quad \text{II}$$

wherein X is a polyol residue, such as ethylene glycol, propylene glycol, glycerol, pentaerythritol, trimethylol propane, and sorbitan, preferably ethylene glycol residue; A and Q are the same as in the formula I; n is 0 to 20, preferably 5 to 15; and x is 1 to 6, preferably 2 to 4;

$$R^1COO(AO)_mOCQCOOH \quad \text{III}$$

wherein $R^1$, A, Q, and m are the same as in the formula II;

$$R^1NH(AO)_mOCQCOOH \quad \text{IV}$$

wherein $R^1$, A, Q, and m are the same as in the formula II;

$$R^1CONH(AO)_mOCQCOOH \quad \text{V}$$

wherein $R^1$, A, Q, and m are the same as in the formula II.

The most preferable monoesters of dicarboxylic acids among those represented by the formulae I to V is the monoesters represented by the formula I:

$$R^1—O—(AO)_mOCQCOOH \quad \text{I}$$

particularly, the compounds in which $R^1$ is 7 to 12 and Q is ethylene. Such compounds can sufficiently emulsify the silicone oil (A) of the present invention.

The above-mentioned monoesters of dicarboxylic acids, represented by the formulae I to V, can be applied by blending two or more of them. But it is preferable to use at least one of the monoesters I. Mono- or polyesters of polycarboxylic acids, of which one or more carboxyl groups among three or more carboxyl groups in one molecule are remained without substituted by alkyl groups, can be applied in combination with the above monoesters of dicarboxylic acid, though such mono- or polyesters do not have higher performance than the monoesters of dicarboxylic acid. In addition, such mono- or polyesters cannot be easily obtained in a homogeneous state from polycarboxylic acids.

The silicone oil (A) of the present invention is emulsified with the emulsifier (B) of the present invention, which comprises 10 to 100 weight percent of the monoesters of dicarboxylic acids represented by the above formulae, I, II, III, IV, and V, and 90 to 0 weight percent of other nonionic surfactants.

The nonionic surfactants are not strictly defined, and any nonionic surfactants available in market can be applied. The preferable nonionic surfactants are polyoxyalkylene higher fatty alcohols, polyoxyalkylene alkylphenols, polyoxyethylene phenylphenols, polyoxyethylene stylenized phenols, polyalkylene glycol higher fatty acid esters, polyoxyalkylene alkyl- or alkylphenylamines, polyoxyalkylene amides, higher fatty acid esters of polyfunctional alcohols, and polyalkylene oxide addition products thereof. The preferable alkylene oxides in the above nonionic surfactants are ethylene oxide, the random or block copolymers of ethylene oxide, and also propylene oxide.

The ratio of the monoesters of dicarboxylic acids in the emulsifier (B) of the present invention should be at least 10 weight percent or more of the emulsifier (B), i.e. the total of the monoester and nonionic surfactant, and preferably be 30 weight percent or more, for satisfiable emulsification of the silicone oil of the present invention.

The emulsifier (B) of the present invention dominates the emulsification level of amino-modified polysiloxanes. And the emulsifier (B) should be formulated to neutralize amino-modified polysiloxanes so as to control the pH of the resultant textile treating composition from 4 to 8. Low pH of the textile treating composition, 4 or less, must be modified by increasing nonionic surfactants other than the monoesters of dicarboxylic acid, and the high pH, 8 or more must be modified by increasing the monoesters of dicarboxylic acids represented by the formulae from I to V. The resultant textile treating composition, of which pH is controlled within the optimum range, from 4 to 8, is stable and gives transparent emulsion.

The textile treating composition which gives transparent emulsion must be formulated by blending the silicone oil (A) and the emulsifier (B) first, then diluting the blend with water into a given concentration, and adding the amino carboxylic acids (C).

The 20 percent emulsion of the textile treating composition prepared in the above procedure should have the transmittance of 60 percent or higher at 660 nm determined with a spectrophotometer in a 1 cm cell employing water as blank.

The emulsion prepared by dissolving the emulsifier (B) and the carboxylic acids (C) in water before adding the silicone oil (A) is not sufficiently transparent due to the coarse globules of the silicone oil dispersed.

The preferable ratio between the silicone oil (A) and the emulsifier (B) of the present invention is 100 to 10–50 weight percent, more preferably 100 to 20–50 weight percent. The preferable ratio of water for preparing the textile treating composition of the present invention is from 60 to 90 weight percent, more preferably from 75 to 80 weight percent of the total of the silicone oil (A) and the emulsifier (B).

The amino carboxylic acids (C) of the present invention include the compounds having one or more amino groups and one or more carboxyl groups in the same molecules, such as amine salts of carboxylic acid, and amino or betaine compounds. And the amino carboxylic acids of poor solubility in water, 0.2 g or less in 100 g of water, cannot be applied.

The carboxylic acids containing amino groups in their molecules include primary, secondary, tertiary, and quaternary amines. Hydroxy amino having hydroxyl groups in their molecules are also applicable.

In addition, aminoethers, which are obtained by reacting ethylene oxide with amino groups, such as the carboxylic acid salt of alkylamine; the carboxylic acid salt of arylamine; and the carboxylic acid salt, amino acid compounds, or betaine compounds of alkylaryl amine. The preferable blend ratio of those amino carboxylic acids is from 0.2 to 10 parts by weight, more preferably from 3 to 5 parts by weight to 100 parts by weight of the total of the silicone oil (A) and the emulsifier (B). Those amino carboxylic acid salts drastically decrease the viscosity of the emulsion of the textile treating composition of the present invention. Such low-viscosity emulsion easily and rapidly spread on the monofilament surface of filament bundles, such as tows, even on the monofilaments locating inside of the filament bundles.

Insufficient ratio of those amino carboxylic acids below 0.2 parts by weight, will fail to decrease the viscosity of the 20 percent emulsion of the textile treating composition down to 10 cSt or less. Excessive ratio of those amino carboxylic acid salts, 10 parts by weight is not practical, as the viscosity of the 20 percent emulsion of the textile treating composition is not decreased correlating to the increase of the ratio of the amino carboxylic acids beyond the 10 parts by weight level.

The aminocarboxylic acids do not cause poor transparency of the resultant emulsion, i.e., coarse globule size of emulsified silicone oil, nor reduce the water repellency, detachability, heat resistance, and peculiar handle imparted to fiber by the textile treating composition.

The aminocarboxylic acids function to decrease the varnish type residue of textile treating composition on dryer rolls in fiber production processes. The low viscosity of the textile treating composition and its aqueous emulsion given by the aminocarboxylic acids is estimated to contribute to the decrease of the varnish type residue.

Japanese Patent KOKAI No. Hei. 6-220722 and No. Hei. 6-220723 disclose the emulsifying method for silicone oils only with conventional nonionic emulsifiers, where lower fatty monocarboxylic acids were required as the emulsifying promoter.

The inventors of the present invention tested the 20 percent aqueous emulsions of the textile treating compositions disclosed in the above two prior arts in the following procedure. The emulsion samples were placed in laboratory dishes respectively, and heated gradually as in the same manner of the fiber-drying processes up to 150° C. so as to the water in the emulsion samples was vaporized completely. Then the samples were cooled down to the room temperature, and observed. The dried textile treating compositions separated into two layers of silicone oils and emulsifiers. The lower fatty monocarboxylic acids added as the emulsifying promoter partially vaporized, and thus the ratio of the components differed from that before the heating.

The above test result suggests that the separation of the components of textile treating compositions causes the falling off of textile treating composition from fiber surface in the drying processes of fiber production or processing. In drying processes, textile treating compositions partially vaporize resulting in the change of components ratio. The components separate into layers lose sufficient affinity to fiber, and thus textile treating compositions fall off from fiber.

The weakly acidic monoesters of dicarboxylic acids employed in the emulsifier (B) of the present invention do not cause the above-mentioned separation of the compositions, contrary to the lower fatty monocarboxylic acids employed in the textile treating compositions disclosed in the prior art.

The textile treating composition of the present invention seldom resulted in such separation of components after heated in the same manner as in the above test, owing to the performance of the weakly acidic monoesters of dicarboxylic acids. And the ratio of the components of the textile treading composition rarely changed after the heating, as the monoesters of dicarboxylic acids do not vaporize in the heating owing to their higher boiling point than that of the lower fatty monocarboxylic acids.

The textile treating composition of the present invention rarely falls off from fiber to the surface of guides or rolls in fiber processing, so as to minimize or eliminate the filament breakage or fluffs due to filament wrap on guides or rolls even in continuous production.

Other components applicable to the textile treating composition of the present invention are cationic or anionic antistats, fatty acid soaps, and lubricants.

The textile treating composition of the present invention should preferably be prepared into 20 percent aqueous emulsion and diluted into 2 percent concentration. The preferable application device is a kiss roll, and the preferable application level is from 1.0 to 1.5 percent (in active content) of fiber weight.

The invention will now be further described in the following specific examples which are to be regarded solely as illustrative and not as restricting the scope of the invention. The percentage mentioned in the following examples refers weight percent unless otherwise specified.

The quantity of the textile treating composition applied on fiber, the globule size of the emulsion, transmittance of the emulsion, the insoluble matter in MEK15 (methyl ethyl keton), and the stain on rolls, of which data are given in the examples, were determined in the following method.

(1) Determination of the quantity of the textile treating composition on fiber

A fiber sample was fused with the mixture of potassium hydroxide and sodium butylate solutions. Then the fused sample was dissolved in water, and the pH of the solution was controlled into 1 with hydrogen chloride. The solution was colored with sodium sulfite and ammonium molybdate to determine the silicon content in the colorimetric determination (at 815 micrometer wave length), of silicon molybdenum blue. The silicon content obtained in this method was calculated into the quantity of textile treating compositions on the fiber sample according to the silicon ratio in the textile treating compositions previously determined in the same manner.

(2) Determination of the globule size

The mean globule size and the size distribution in the 20 percent aqueous emulsion of the textile treating compositions were determined with a laser scattering particle size distribution analyzer (LA-910, by Horiba Ltd.).

(3) Determination of transmittance

The transmittance of the 20 percent aqueous emulsion of the textile treating compositions was determined in 1 cm cell at 660 micrometer wave length, applying water as the blank, with a spectrophotometer (100-10, by Hitachi Co., Ltd.).

(4) Determination of insoluble matter in MEK

The 20 percent aqueous emulsion of a textile treating composition was weighed in approx. 5 g in an aluminum dish (6 cm in diameter, 1.5 cm deep), heated in an oven at 150° C. for one hour, and weighed (A g). Then the sample was further heated in an oven at 230° C. for one hour. The heated sample was dissolved in 50 ml of MEK and transferred in a beaker, and agitated for 5 minutes at room temperature. The solution was then filtrated through a glass filter of know weight. The residue was rinsed with 50 ml of MEK two times to remove the soluble matter in MEK. The residue on the filter was dried in an oven at 105° C. for 30 minutes, and weighed (B g).

The weight of the insoluble matter in MEK was obtained by the following formula.

$$\text{weight of insoluble matter in } MEK\text{ (g)} = \frac{B\text{ (g)} - \text{weight of glass-filter (g)}}{A'\text{ (g)}} \times 100$$

$$A' = \left(A - \text{weight of aluminum dish}\right) \times \text{ratio of silicone oil in textile treating composition}$$

The insoluble matter in MEK indicates the gelling of the heated textile treating compositions. More gelling of textile treating composition is preferable for attaining durable water repellency, detachability, heat resistance and peculiar fiber handle. The desirable level of the insoluble matter in MEK is 30 percent or more for attaining satisfiable durability of the above properties.

(5) Stain on rolls

The varnish type residue (stain) stuck on the surface of rolls (mirror-finished chromium-plated rolls) employed in a continuous fiber processing operation was visually inspected, and ranked into five groups as shown in Table 1.

TABLE 1

| grade of stain | state of stain on rolls |
|---|---|
| 1 | no stain after 8 hrs. processing |
| 2 | slight stain after 8 hrs. processing, and no stain after 4 hrs. processing |
| 3 | slight stain after 4 hrs. processing |
| 4 | stain after 4 hrs. processing, and no stain after 1 hr. processing |
| 5 | stain after 1 hr. processing |

EXAMPLE 1

Copolymer of acrylonitrile 92 percent and methylacrylate 8 percent was spun in wet spinning process, rinsed with water, and drawn. The resultant wet fiber was applied with four variants of textile treating composition and dried to be prepared into four different tow samples. The monofilament thickness was 2.0 denier, and the single tow was 100,000 denier. The amount of amino-modified polysiloxane on each of the tow samples applied with the textile treating compositions 1, 2, 3, and 4 was 1.16 percent, 1.19 percent, 1.11 percent, and 1.17 percent respectively.

The stain on rolls given by the above four tow samples was observed as shown in Table 2. The textile treating compositions applied to the tow had the following formulae.

| Textile treating composition 1 (of the present invention) The major components and their blend ratio are as follows. | |
|---|---|
| amino-modified polysiloxane*1: | 66.7 |
| POE(12)*2 nonylphenyl succinic monoester: | 13.3 |
| POE(12) nonylphenyl ether: | 10 |
| POE(7) nonylphenyl ether: | 10 |

*1: amino-modified polysiloxane, wherein a primary amine and a secondary amines were contained at the amount represented by 0.8% nitrogen, of which viscosity was 1,500 cSt

*2: POE represents polyoxyethylene residue, and the figures in the parentheses represent the number of ethylene oxide.

The textile treating composition 1 was prepared by blending 100 parts by weight of the above major components with 3 parts by weight of β-alanine, applicable as the aminocarboxylic acids (C) of the present invention.

| Textile treating composition 2 (of the present invention) The major components and their blend ratio are as follows. | |
|---|---|
| amino-modified polysiloxane*[1]: | 65 |
| POE(12) nonylphenyl maleic monoester: | 15 |
| POE(12) nonylphenyl ether: | 10 |
| POE(7) nonylphenyl ether: | 10 |

*[1]: the same polysiloxane as in the composition 1.

The textile treating composition 2 was prepared by blending 100 parts by weight of the above major components with 4.5 parts by weight of dibutylethanolamine acetate, applicable as the aminocarboxylic acids (C) of the present invention.

| Textile treating composition 3 (comparative example) The major components and their blend ratio are as follows | |
|---|---|
| amino-modified polysiloxane*[1]: | 66.7 |
| POE(9) nonylphenyl phosphate (monophosphate): | 6.6 |
| POE(9) nonylphenyl ether: | 26.7 |

| Textile treating composition 4 (comparative example) The major components and their blend ratio are as follows | |
|---|---|
| amino-modified polysiloxane*[1]: | 66.7 |
| POE(9) nonylphenyl ether: | 33.3 |

*[1]: the same polysiloxane as in the composition 1.

The textile treating composition 4 was prepared by blending 100 parts by weight of the above major component with 4.5 parts by weight of dibutylethanolamine acetate, as the aminocarboxylic acids.

As apparent in Table 2, the textile treating compositions 1 and 2 of the present invention gave slight stain on rolls, while the textile treating composition 4, the comparative example, gave considerable stain on rolls for 1 hr. operation.

The textile treating composition 3 was found to have generated a lot of siloxane oligomer (300 to 600 M.W.), approximately ten times of those generated from the other textile treating compositions, through the analysis with gel-permeation chromatography on the textile compositions extracted with MEK from the fiber stored for one year after applied with the textile treating compositions 1, 2, 3, and 4. The strong acid groups in the monophosphate blended as the emulsifier in the textile treating composition 3 is estimated to have facilitated the degradation of the amino-modified polysiloxane into smaller molecules.

TABLE 2

| Composition Testing | 1 Ex. | 2 Ex. | 3 Comp. | 4 Comp. |
|---|---|---|---|---|
| Stain on rolls | 1 | 1 | 1 | 5 |
| pH (20% aq. emul.) | 6.0 | 5.2 | 6.4 | 4.9 |
| Viscosity (cSt) (20% aq. emul.) | 2.4 | 2.5 | 2.6 | 2.7 |
| Transmittance (%) (20% aq. emul.) | 93 | 92 | 98 | 93 |
| Insoluble matter in MEK (%) | 85 | 87 | 12 | 81 |

EXAMPLE 2

A textile treating composition was formulated by blending 0.1 to 10 parts by weight of glycine with 100 parts by weight of the following major component.

| | |
|---|---|
| amino-modified polysiloxane*[1]: | 70 |
| POE(12) nonylphenyl succinic monoester: | 10 |
| POE(12) nonylphenyl ether: | 10 |
| POE(7) nonylphenyl ether: | 10 |

*[1]: amino-modified polysiloxane, containing a primary amine of which amount is represented by 0.4% nitrogen, of which viscosity was 1,700 cSt The resultant textile treating composition was prepared into 20 percent aqueous emulsion, and tested on transmittance and viscosity. The result was shown on Table 3.

As apparent from Table 3, the textile treating composition blended with 0.2 percent or more of glycine gave low-viscous aqueous emulsion, which could be easily prepared.

TABLE 3

| glycine content | 0 | 0.1 | 0.2 | 1.0 | 3.0 | 5.0 | 10.0 |
|---|---|---|---|---|---|---|---|
| Transmittance (20% aq. emul.) | 98 | 98 | 98 | 98 | 98 | 97 | 95 |
| Viscosity (cSt) (20% aq. emul.) | 26 | 14 | 8 | 4.2 | 2.8 | 2.4 | 2.3 |

EXAMPLE 3

Six variants of textile treating compositions were prepared by blending 100 parts by weight of the major components, in which the ratio of the emulsifiers was varied as shown in Table 4, with 3 parts by weight of β-alanine. The textile treating compositions were tested on transmittance and pH as also shown in Table 4.

| | |
|---|---|
| amino-modified polysiloxane*[1]: | 70 |
| Emulsifier: | 30 |
| X: POE(12)*[2] nonylphenyl succinic monoester | |
| Y: POE(12) nonylphenyl ether | |
| Z: POE(7) nonylphenyl ether | |

*[1]: amino-modified polysiloxane, containing a primary amine of which amount if represented by 0.4% nitrogen, of which viscosity was 1,700 cSt
*[2]: POE represents polyoxyethylene residue, and the figures in the parentheses represent the number of ethylene oxide.

TABLE 4

| Emulsifier ratio | Transmittance (%) | pH |
|---|---|---|
| X/Y/Z - 100/0/0 | 96 | 4.1 |
| X/Y/Z - 70/15/15 | 93 | 5.2 |
| X/Y/Z - 40/30/30 | 93 | 5.7 |
| X/Y/Z - 20/40/40 | 88 | 5.8 |
| X/Y/Z - 10/45/45 | 72 | 6.4 |
| X/Y/Z - 0/50/50 | 0.1 | 7.1 |

EXAMPLE 4

Copolymer of acrylonitrile 98 percent and methaacrylate 2 percent was spun, rinsed with water, and drawn. The resultant wet fiber was applied with four variants of textile treating composition described below and dried to be prepared into four different multifilament yarn sample, of which monofilament thickness was 1.0 denier.

The amount of the silicon oil on each of the yarn samples applied with the textile treating compositions 5, 6, 7, and 8 was 1.4 percent, 1.2 percent, 1.5 percent, and 1.3 percent respectively. And the yarn samples were tested on the stain on roll. The data is shown in Table 5 with the data of the 20 percent emulsion of the textile treating compositions from 5 to 8.

| Textile treating composition 5 (of the present invention) The major components and their blend ratio are as follows. | |
|---|---|
| amino-modified polysiloxane*[1]: | 65 |
| POE(12) nonylphenyl maleic monoester: | 15 |
| POE(12) nonylphenyl ether: | 10 |
| POE(7) nonylphenyl ether: | 10 |

*[1]: amino-modified polysiloxane, containing a primary amine of which amount is represented by 0.5% nitrogen, of which viscosity was 1,700 cSt The textile treating composition 5 was prepared by blending 100 parts by weight of the above major components with 2 parts by weight of β-alanine.

| Textile treating composition 6 (of the present invention) The major components and their blend ratio are as follows. | |
|---|---|
| amino-modified polysiloxane*[1]: | 50 |
| ether-modified polysiloxane*[2]: | 20 |
| POE(12) nonylphenyl succinic monoester: | 10 |
| POE(12) nonylphenyl ether: | 10 |
| POE(7) nonylphenyl ether: | 10 |

*[1]: amino-modified polysiloxane, containing a primary amine of which amount is represented by 0.5% nitrogen, of which viscosity was 1,700 cSt
*[2]: ether-modified polysiloxane, having approx. 50% POE in the molecules, of which viscosity was 4,000 cSt, soluble in water The textile treating composition 6 was prepared by blending 100 parts by weight of the above major components with 5 parts by weight of POE (2) laurylamino ether acetate.

| Textile treating composition 7 (of the present invention) The major components and their blend ratio are as follows. | |
|---|---|
| amino-modified polysiloxane*[1]: | 65 |
| POE(12) nonylphenyl maleic monoester: | 15 |
| POE(12) nonylphenyl ether: | 10 |
| POE(5) laurylamide ether: | 10 |

*[1]: amino-modified polysiloxane, containing a primary amine of which amount is represented by 0.5% nitrogen, of which viscosity was 1,700 cSt The textile treating composition 7 was prepared by blending 100 parts by weight of the above major components with 3 parts by weight of β-alanine, and 3 parts by weight of the antioxidant, ADEKASTAB AO-23, available from Adeka Argus Chemical Co., Ltd.

| Textile treating composition 8 (of the present invention) The major components and their blend ratio are as follows. | |
|---|---|
| amino-modified polysiloxane*[1]: | 70 |
| POE(9) nonylphenyl ether: | 30 |

*[1]: amino-modified polysiloxane, containing a primary amine of which amount is represented by 0.5% nitrogen, of which viscosity was 1,700 cSt The textile treating composition 8 was prepared by blending 100 parts by weight of the above major components with 3 parts by weight of L-glutamic acid, and 3 parts by weight of the antioxidant, ADEKASTAB AO-23, available from Adeka Argus Chemical Co., Ltd.

TABLE 5

| Composition Testing | 5 Ex. | 6 Ex. | 7 Ex. | 8 Comp. |
|---|---|---|---|---|
| Stain on rolls | 1 | 1 | 1 | 5 |
| pH (20% aq. emul.) | 5.0 | 5.2 | 5.7 | 4.4 |
| Viscosity (cSt) (20% aq. emul.) | 2.7 | 2.5 | 3.3 | 8.3 |
| Transmittance (%) (20% aq. emul.) | 93 | 92 | 98 | 94 |
| Insoluble matter in MEK (%) | 86 | 87 | 60 | 45 |

The textile treating composition of the present invention minimizes stain on rolls in fiber processing to improve the efficiency of continuous fiber processing. And the water repellency, detachability, heat resistance, and peculiar handle imparted to fiber last for a long time as the amino-modified polysiloxane in the textile treating composition is not degraded into smaller molecules.

What is claimed is:

1. A textile treating composition consisting essentially of;

a silicone oil containing at least 50 weight percent of amino-modified polysiloxane having a viscosity of at least 50 cSt at 25° C.;

an emulsifier containing from 10 to 100 weight percent of monoesters of dicarboxylic acids, and from 90 to 0 weight percent of nonionic surfactants; and amino carboxylic acids, which have an amino group and a carboxyl group in one molecule and solubility in water of higher than 0.2 g in 100 g of water, being present in an amount from 0.2–10 parts to 100 pans of the mixture of (A) and (B).

2. The composition define claim 1, makes an aqueous emulsion having a transmittance of at least 60 percent when dispersed at 20% concentration.

3. The composition defined m claim 1, wherein said amino-modified polysiloxane includes 0.05 to 2.0 weight percent of nitrogen.

4. The composition defined in claim 1, wherein the monsters of dicarboxylic acids include at least one of compounds represented by formula I:

$$R^1—O—(A)_m OCQCOOH \qquad I$$

wherein $R^1$ is a saturated or unsaturated $C_6$–$Q_{22}$ hydrocarbon group, which may be linear or branched, being selected from the group consisting of alkyl groups, aralkyl groups, and aryl groups permissibly having one or more alkyl substituents; A is independently a $C_2$–$C_4$ alkylene group or groups, which may be the same or different; Q is a dicarboxylic acid radical; and m is 0 to 20.

5. The composition defined in claim 4 wherein A is a member selected from the group consisting of ethylene, propylene, trimethylene, butylene, isobutylene and mixtures thereof.

* * * * *